US008678742B2

(12) United States Patent
Klingels

(10) Patent No.: US 8,678,742 B2
(45) Date of Patent: Mar. 25, 2014

(54) CLEARANCE CONTROL SYSTEM, TURBOMACHINE AND METHOD FOR ADJUSTING A RUNNING CLEARANCE BETWEEN A ROTOR AND A CASING OF A TURBOMACHINE

(75) Inventor: Hermann Klingels, Dachau (DE)

(73) Assignee: MTU Aero Engines GmbH, Munich (DE)

( * ) Notice: Subject to any disclaimer, the term of this patent is extended or adjusted under 35 U.S.C. 154(b) by 199 days.

(21) Appl. No.: 13/266,268

(22) PCT Filed: May 19, 2010

(86) PCT No.: PCT/DE2010/000570

§ 371 (c)(1),
(2), (4) Date: Oct. 26, 2011

(87) PCT Pub. No.: WO2010/136018

PCT Pub. Date: Dec. 2, 2010

(65) Prior Publication Data

US 2012/0063884 A1 Mar. 15, 2012

(30) Foreign Application Priority Data

May 28, 2009 (DE) ..... 10 2009 023 061

(51) Int. Cl.
*F01D 11/22* (2006.01)

(52) U.S. Cl.
USPC ..... 415/1; 415/118; 415/127; 415/173.2; 415/174.1

(58) Field of Classification Search
USPC ..... 415/118, 126, 127, 173.1–173.3, 174.1, 415/213.1, 1
See application file for complete search history.

(56) References Cited

U.S. PATENT DOCUMENTS

| | | | | |
|---|---|---|---|---|
| 4,329,114 | A | 5/1982 | Johnston et al. | |
| 4,332,523 | A | 6/1982 | Smith | |
| 4,343,592 | A * | 8/1982 | May | 415/173.2 |
| 5,049,033 | A * | 9/1991 | Corsmeier et al. | 415/173.2 |
| 5,054,997 | A * | 10/1991 | Corsmeier et al. | 415/173.2 |
| 5,096,375 | A | 3/1992 | Ciokailo | |
| 5,104,287 | A | 4/1992 | Ciokajlo | |
| 2007/0003411 | A1 * | 1/2007 | Manzoori | 415/173.2 |

FOREIGN PATENT DOCUMENTS

| | | | |
|---|---|---|---|
| DE | 2060496 | A1 | 5/1972 |
| DE | 4028328 | A1 | 3/1991 |
| DE | 102004037955 | A1 | 3/2006 |
| DE | 102008037429 | A1 | 4/2009 |

(Continued)

*Primary Examiner* — Edward Look
*Assistant Examiner* — Jesse Prager
(74) *Attorney, Agent, or Firm* — Barlow, Josephs & Holmes, Ltd.

(57) ABSTRACT

The invention relates to a clearance control system for adjusting a running clearance (L) between a rotor (12) having rotor blades (10) of a turbomachine (14), especially a gas turbine, and a casing (18) that surrounds at least sections thereof and comprises at least two segments (16*a-d*), the clearance control system having at least one adjusting device (20), which can be coupled to at least one segment (16*a-d*) of the casing (18), and by means of which the at least one segment (16*a-d*) can be moved radially in relation to a rotational axis (D) of the rotor (12) for adjusting the running clearance (L), wherein each segment (16*a-d*) of the casing (18) is coupled to at least three adjusting devices (20) of the clearance control system. The invention also relates to a turbomachine (14), especially a gas turbine, as well as to a method for adjusting a running clearance (L).

31 Claims, 6 Drawing Sheets

(56) References Cited

FOREIGN PATENT DOCUMENTS

| | | | | |
|---|---|---|---|---|
| EP | 0230177 | A1 | | 7/1987 |
| EP | 1655455 | A1 | | 5/2006 |
| EP | 1741880 | A2 | | 1/2007 |
| GB | 2099515 | A | | 12/1982 |
| GB | 2108591 | A | | 5/1983 |
| GB | 2440744 | A | * | 2/2008 |
| JP | 57026211 | A | | 2/1982 |

* cited by examiner

CLEARANCE CONTROL SYSTEM, TURBOMACHINE AND METHOD FOR ADJUSTING A RUNNING CLEARANCE BETWEEN A ROTOR AND A CASING OF A TURBOMACHINE

The invention relates to a clearance control system for adjusting a running clearance between a rotor having rotor blades of a turbomachine, especially a gas turbine, and a casing that surrounds at least sections thereof and comprises at least two segments. The invention further relates to a turbomachine, especially a gas turbine, of the type given in the preamble of patent claim 23 as well as a method for adjusting a running clearance between a rotor having rotor blades of a turbomachine, especially a gas turbine, and a casing that surrounds at least sections thereof and comprises at least two segments.

The efficiency of a turbomachine—for example, a compressor or a turbine, depends largely on the magnitude of the radial running clearance between a rotor and static components of the turbomachine. In the case of compressors, the position of the pump limit—that is, the limit up to which a stable operation of the turbomachine is possible—is governed essentially by the magnitude of the running clearance. Therefore, the realization of radial running clearances that are as small as possible and remain constant over the operating period of the turbomachine is a primary design objective. This is all the more important the smaller the dimensions of the rotor blades of the rotor. For example, this is the case for the back stages of a high-pressure compressor or of a turbomachine designed as a high-pressure turbine.

Figure 1:
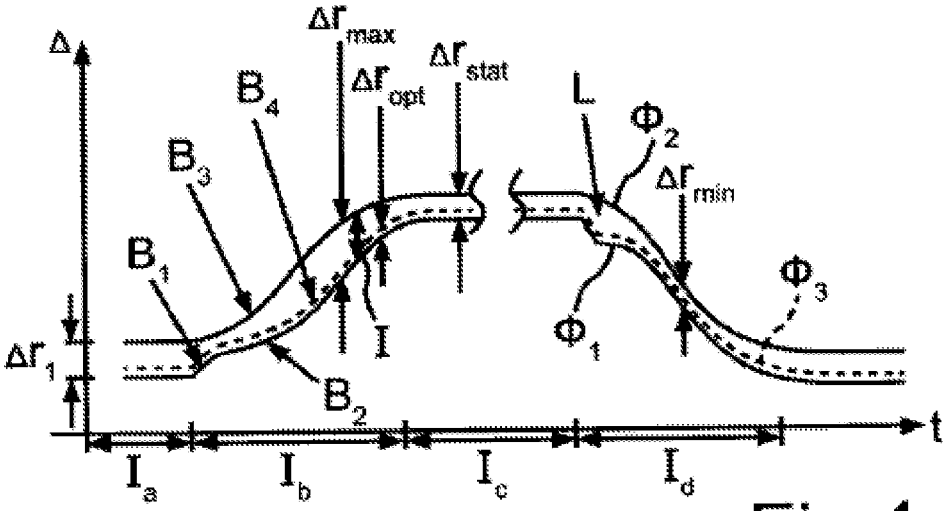

If the running clearances of a turbomachine are regarded, it is found that the running clearance can vary relatively strongly on account of the differing temporal expansion behaviors of the rotor and its casing, which may be designed as a housing or part of a housing, for example. For more detailed explanation, FIG. 1 shows a schematic line chart of the time- and load-dependent change in clearance between a rotor blade and surrounding casing of a turbomachine, as typically arises during the operation of a turbomachine, designed as a high-pressure compressor and known from prior art, for an engine of the 30-klb thrust class. Here, the solid line $\phi_1$ describes the radius of the rotor disk and the solid line $\phi_2$ a radius of the casing, whereas the dotted line $\phi_3$ describes the radius of the casing required to adjust a running clearance L having an optimal magnitude $\Delta r_{opt}$.

It should be possible here to use a clearance control system to adjust the optimal magnitude $\Delta r_{opt}$ of the running clearance L. In the embodiment example shown, the objective is to obtain an at least nearly constant running clearance L with the magnitude $\Delta r_{opt}$=0.1-0.2 mm. During acceleration (phase Ib) from an idling phase Ia, in which the running clearance L has the initial magnitude $\Delta r_1$, the radius of the rotor or of the rotor disk in the region $B_1$—proportional to the change in rpm—experiences a change in radius due to the acting centrifugal forces. By contrast, a thermally caused expansion of the rotor disk occurs markedly slower (region $B_2$) on account of its relatively large radial extension and great mass. The casing, with its lesser mass in comparison to the rotor, responds, as a rule, appreciably faster (region $B_3$). During acceleration according to phase Ib, therefore, the originally existing running clearance L=$\Delta r_1$ decreases, initially because of the very fast-acting centrifugal force expansion of the rotor and then becomes markedly greater, because the thermal response of the casing is faster. In the region $B_4$, the running clearance L reaches its maximum value $\Delta r_{max}$—e.g., $\Delta r_{max}$=0.8 mm—above which is defined the required adjustment range, marked with the arrow I, of the casing or of segments of the casing.

Once the rotor, too, is thoroughly heated, the stationary running clearance magnitude $\Delta r_{stat}$—e.g., $\Delta r_{stat}$=0.4 mm—in phase Ic is reached. On delay in phase Id, the running clearance L initially increases because of the ever-decreasing centrifugal force load on the rotor. Subsequently, the running clearance L becomes smaller once again and reaches its minimum value $\Delta r_{min}$, because the casing cools faster than the rotor. During cooling of the turbomachine, the initial magnitude $\Delta r_1$ of the running clearance L adjusts once again after a certain time. It is evident from FIG. 1 that the required adjusting stroke of the casing is relatively small and less than 1.00 mm. In order to achieve a marked improvement, therefore, clearance control systems that have adjusting devices and function as precisely as possible are required.

The described transient clearance behavior of a purely passive clearance control system and the requirement that a "hard" brushing of the rotor blades against the casing be absolutely prevented leads, particularly in the high-pressure region of modern turbomachines, to stationary running clearance magnitudes $\Delta r_{stat}$ in the range of about 2-3% of the height of the rotor blades. The maximum running clearance magnitudes $\Delta r_{max}$ that arise during transient operation, however, can reach values more than twice as high. The magnitude of the running clearance of a turbomachine depends in summary on various influencing variables:

- expansion of the rotor due to the effects of centrifugal force;
- thermal expansions of the rotor and the casing;
- expansions and ovalization of the casing due to maneuver loads and compressive forces;
- displacement between the rotational axis of the rotor and the central axis of the casing due to maneuver loads; as well as
- fabrication tolerances, such as, for example, out of roundness or eccentricities.

In the passive clearance control systems known from prior art, an attempt is made on the basis of the mass of the rotor and the casing and the mass distribution thereof, through suitable guiding of the secondary air flows as well as through influencing the heat flow by means of geometrically optimized design and thermal insulation layers, to optimize the expansion behavior of the turbomachine components such that the smallest possible differential expansions are obtained between the rotor and the stator or its casing.

Thermally active clearance control systems in which the running clearance is optimized by targeted cooling or heating of the relevant components represent alternatives. Examples of this are the clearance control systems of the CFM56 engine family, for which the rotor temperature is regulated, or the clearance control system known from U.S. Pat. No. 4,329,114, by means of which the housing temperature of the turbomachine is regulated. Because these clearance control systems act only via influencing the component temperatures, they respond relatively slowly and can therefore significantly improve only the stationary running clearance. However, this clearance control system cannot respond or can respond in an only very limited manner to rapid changes in the running clearance—such as those arising during transient operating states, as described above—to a displacement between a rotational axis of the rotor and a central axis of the casing, and to eccentricities, such as those arising during maneuver loads.

As further alternatives, mechanically active clearance control systems are known. In order to achieve a running clearance that is as small as possible taking into consideration the mentioned influencing variables, it should be possible for the casing of the rotor to adapt as well as possible at every point in time to the diameter and relative position thereof. For this purpose, the casing is often segmented. For example, GB 2108591 A shows a clearance control system of such a segmented casing of a turbomachine. In it, three respective segments are each coupled to one another through a lever mechanism. These mutually coupled segments are each shifted uniformly using an actuator depending on measured signals of several sensor devices. The running clearance for each of these mutually coupled segment groups can hereby be adjusted by way of the circumferential extension of the segment group to a mean running clearance. When the diameter of the rotor and casing change, the clearance control system thus affords relatively good results in comparison to thermally active clearance control systems.

A displacement between the rotational axis of the rotor and the central axis of the casing as well as ovalizations of the casing cannot be compensated or cannot be satisfactorily compensated, however. Because the segments of the segment group in the circumferential direction are fixed in position, sickle-shaped running clearances are created when there is a displacement of the rotational axis of the rotor with respect to the central axis of the casing, because all coupled segments of the casing carry out the same stroke movement. In order to achieve an improved adjustability in comparison to a passive clearance control system, a relatively large number of twelve or more segment groups are additionally required. At the same time, a corresponding number of actuators and sensor devices are also needed, resulting in an increase in required design space and vulnerability to flaws, besides an increase in manufacturing costs.

Reference is also made to a turbomachine having a segmented casing in GB 2099515 A, in which each segment can be moved by way of a clearance control system in order to adjust the running clearance. The segments are moved between wedge-shaped guide elements, with a Belleville spring stack moving the segments radially outward in relation to the rotational axis of the rotor and the clearance control system moving the segments radially in the direction of the rotor. In order to be able to adjust the running clearance over the entire circumference of the casing, however, a large number of actuators and sensor devices are required, as result of which the running clearance system is not only expensive and heavy, but also has a relatively high breakdown probability.

U.S. Pat. No. 5,104,287 describes a clearance control system for a segmented casing of a rotor having rotor blades of a turbomachine. Each segment of the casing can be moved radially in relation to the rotational axis of the rotor by using two associated adjusting devices of the clearance maintenance system, which comprise threaded spindles. To this end, the adjusting devices, designed as an adjusting gear unit, are each coupled in pairs with an adjusting element designed as a ring and arranged concentrically around the rotor. The adjustment of the running clearance is done by turning the ring, the rotary movement of which is transformed by the adjusting devices into a uniform radial movement of the segments away from the rotor. Arranged between the segments and a support housing of the casing are corrugated flat springs, which press the segments radially inward, that is, in the direction of the rotor.

It is regarded as a drawback here that the segments of the casing can be moved radially only jointly, so that only a few of the above-mentioned influencing variables can be counteracted. In particular, ovalizations of the casing or a displacement between the rotational axis of the rotor and the central axis of the casing cannot be compensated. A further drawback is that the flat springs and the adjusting devices come into direct contact with the high rotor compartment temperatures during operation of the turbomachine. In the case of modern turbomachines, designed as gas turbines, with high total pressure situations, however, the temperatures cannot be so high that the spring action of the flat springs is lost or the load-bearing capacity of the adjusting devices is no longer adequate. In addition, the clearance control system has a high complexity as well as a relatively large weight, as a result of which, besides the manufacturing and servicing costs, the breakdown probability of the entire clearance maintenance system is increased.

The problem of the present invention, therefore, is to create a clearance control system of the type mentioned in the beginning, which enables, in a simply designed way, a compensation of as many influencing variables as possible and thus a reliable and safe-to-operate adjustability of the running clearance under various operating conditions of the associated turbomachine. A further problem consists in creating a turbomachine having such a clearance control system as well as a corresponding method for adjusting a running clearance of a turbomachine.

The problems are solved in accordance with the invention by a clearance control system having the features of patent claim 1, by a turbomachine having the features of patent claim 23, and by a method for adjusting a running clearance according to patent claim 31. Advantageous embodiments with appropriate further developments of the invention are presented in the respective dependent claims, in which advantageous embodiments of the clearance control system are to be regarded as advantageous embodiments of the turbomachine or of the method and vice versa.

A clearance control system, which, in a simply designed way, enables a compensation of as many influencing variables as possible and thus a reliable and safe-to-operate adjustability of the running clearance under various operating conditions of the associated turbomachine is created in accordance with the invention in that each segment of the casing is coupled to at least three adjusting devices of the clearance control system. The adjusting devices here can fundamentally comprise elements such as adjusting gear units, actuators, control rods, and the like or any arbitrary combination of these elements or be made up of them. As a result, it is possible, in contrast to prior art, to force the segments, regardless of the operating state, onto a circular path and thus ensure a continual and constant curvature of the segments. Because the segments of the casing are laid out on a specific diameter, sickle-shaped running clearances—as described in prior art—can result during purely radial movement of the segments. In addition, during non-stationary operating states of the turbomachine, a radial temperature gradient, which might change the curvature in an uncontrolled manner, as well as deformations due to mechanical stress (for example, due to gas loads) must be taken into account. In order for the segments to have the desired constant curvature, regardless of operating state, each segment is coupled at least at three points on the circumference with one of the respective adjusting devices and can thus be forced onto a circular path with the current rotor diameter plus the desired running clearance. As a rule, it has proved advantageous here to arrange the adjusting devices at equal spacings from one another so as to ensure a corresponding uniform force distribution over the segment and a good adjustment of the circular arc shape. The running clearance can be optimally adjusted using the clearance control system in accordance with the invention independently of the associated turbomachine, as a result of which the efficiency of the turbomachine is increased and its fuel consumption is correspondingly reduced. On account of the simply designed construction of the clearance control system in accordance with the invention, appreciable savings in cost and weight as well as an advantageously increased reliability and maintenance friendliness additionally result in comparison to known clearance control systems. The clearance control system is fundamentally suitable both for a single stage and for several stages of a turbomachine.

In an advantageous embodiment of the invention, it is provided that two adjusting devices are provided on oppositely placed edge regions of their associated segment and/or an adjusting device is arranged in the center of their associated segment. Since two adjusting devices engage at the segment edges of the segments, the desired circular segment path can be especially reliably maintained with retention of the required tangential conditions under all operating conditions. Since an adjusting device is arranged in the center of its associated segment, it is possible, alternatively or additionally, also to achieve an advantageous force transfer into the segment. Production of the constant, circular path-shaped curvature of the segment, regardless of operating state, can thus be realized in an especially simple manner.

An especially weight- and space-saving arrangement is afforded in another embodiment in that at least two adjacent segments are coupled to a common adjusting device. In addition, in this way, a high tightness of the casing and a correspondingly high efficiency of the turbomachine is ensured. A coupling by means of the adjusting device enables adjacent edge regions of two segments to be radially moved jointly in an advantageous manner. In this way, a steady transition from one segment to the adjacent segment is ensured, so that the formation of sickle-shaped running clearances is prevented in an especially reliable manner. In addition, this also results at the juncture in the achievement of a high freedom of play between the segments and the adjusting device. Advantageously, it may be provided that all adjacent segments are coupled to one or more common adjusting devices so as to obtain an optimized arrangement.

Provided in an advantageous embodiment of the invention is an adjusting element that can be arranged around the rotor and is coupled to at least on adjusting device, relative to which it can be moved for actuating the adjusting device. This enables a simply designed, cost-effective and space-saving arrangement of the adjusting element in the region of the rotor and the casing. In addition, a good distribution of forces arising during movement and pivoting of the adjusting element is possible, as a result of which the mechanical stability and service life of the adjusting element is correspondingly lengthened. The adjusting element may be designed in this case, at least in essence, as a ring.

Further advantages result when the adjusting element comprises several subsections, which are preferably joined together in an articulated manner. As a result of this, the adjusting element has additional degrees of freedom of movement, to that an additionally improved adjustability of the running clearance during pivoting of the adjusting element is enabled. Thus, for example, an ovalization of the casing due to maneuver loads and compressive forces can be compensated for in an especially simple manner through relative movement of the subsections with respect to one another.

Additional advantages result when the adjusting element can be shifted axially in relation to the rotational axis of the rotor and/or can be pivoted with respect to the rotor in order to adjust the running clearance. In contrast to prior art, the clearance control system in accordance with the invention enables, through axial movement of the adjusting element, a uniform movement of the segments over the circumference of the rotor and a correspondingly uniform change in the running clearance. Alternatively or additionally, through pivoting or tilting of the adjusting element with respect to the rotational axis of the rotor, it is possible to produce a non-uniform movement of the segments over the circumference of the rotor, so that ovalization of the casing due to maneuver loads and compressive forces as well as any displacement between the rotational axis of the rotor and the central axis of the casing can facilely be taken into account.

In another advantageous embodiment of the invention, it is provided that at least one of the adjusting devices is designed to transform an at least predominantly axial movement of the adjusting element into an at least predominantly radial movement of the associated segment of the casing. Thus, the adjusting device can be used to transform large movements of the adjusting element advantageously into small movements of the associated segment and vice versa, as a result of which especially an precise adjustability of the running clearance is afforded. Advantageously, it is provided that all adjusting devices are designed in this way.

In another advantageous embodiment of the invention, it is provided that at least one adjusting device is fixed in place on a support housing. This results in an especially stable and safe-to-operate arrangement of the adjusting device. The support housing in this case may, for example, be designed as an outer housing of the turbomachine or else be arranged inside of a separate outer housing.

In another advantageous embodiment of the invention, it is provided that the support housing has a ring-shaped design and/or is arranged on the outer circumference of the casing and/or concentric to the rotational axis of the rotor. As a result of this, the mechanical and design characteristics of the support housing can be adapted optimally to the requirements of the turbomachine.

Further advantages result when at least one sealing element is provided, by means of which the support housing can be sealed with respect to the casing. This results in the prevention of an undesired escape or backflow of the working medium of the turbomachine, thereby ensuring a correspondingly higher efficiency.

It has been found to be advantageous in a further embodiment when the casing comprises at least one guide vane and/or is supported by means of a thrust rod with respect to the support housing. In known clearance control systems and turbomachines, the guide vanes are usually attached to the support housing, so that no influence can be exerted on the inner running clearance. When the casing comprises at least one guide vane—for example, when the guide vane is fixed in place on the casing—the guide vane can be moved as well with respect to the casing during adjustment of the running clearance of the rotor, as a result of which the inner clearance of the turbomachine can be adjusted. In addition, an arrangement of the at least one guide vane on the casing enables arising forces to be dissipated and distributed especially well during operation of the turbomachine. Advantageously, it may be provided that the at least one guide vane is supported on the support housing in the circumferential and/or axial direction.

Further advantages result when at least one sensor device is provided, by means of which the magnitude of the running clearance can be determined. This enables an especially simple, fast, and precise determination of the running clearance. The sensor device may fundamentally operate according to different physical principles—for example, capacitatively, inductively, optically, with microwaves, or with eddy current.

Arranging the sensor device in the region of at least one adjusting device affords an additional improvement of the adjustability of the running clearance, because movements of the casing or the respective segment associated with the adjusting device can be made by means of the sensor device near to the coupling region of the adjusting device.

In another advantageous embodiment of the invention, several sensor devices are provided, which are arranged at a spacing from one another, preferably uniformly, and/or can be arranged on the outer circumference of the casing. In this way, it is possible to determine the running clearance by means of several sensor devices at various positions on the circumference of the rotor. The running clearance can thus be determined in an especially precise and spatially resolved manner, so that different adjusting movements of the segments can correspondingly be made in a targeted manner and a more uniform running clearance can be produced.

In another advantageous embodiment of the invention, it is provided that at least one actuator coupled to the adjusting element is provided, by means of which the adjusting element can be shifted axially in relation to the rotational axis of the rotor or can be pivoted with respect to the rotor. By using at least one actuator, the adjusting element can be moved in an especially simple and precise manner. Together with the adjusting devices, it is thereby possible to transform large movements of the at least one actuator into small movements of the segments or vice versa. The actuator can function fundamentally according to different physical principles—for example, hydraulically, pneumatically, electrically, piezoelectrically, or magnetically.

In another advantageous embodiment of the invention, it is provided that the at least one actuator is arranged in the region of at least one adjusting device. This affords an especially short force transmission path and a correspondingly precise adjustability of the running clearance. Alternatively or additionally, it can be provided that the actuator is arranged in the region of the sensor device. On account of the small spatial distance between the sensor device and the actuator, this results in a simplified and especially precise adjustability of the running clearance.

Further advantages result when several actuators are provided, which are arranged at a spacing from one another, preferably uniformly, and/or can be arranged on the outer circumference of the casing. The use of several actuators at various positions on the circumference enables the adjusting element to be moved or pivoted axially in an especially simple manner, as a result of which identical or different stroke movements of the segments can be carried out in a targeted manner in order to adjust the running clearance. When the actuators are arranged in the region of respectively associated sensor devices, it is further possible advantageously to suppress or render impossible any mutual influencing of several actuators and sensor devices.

A further improvement of the adjustability of the running clearance is afforded in a further embodiment in that at least one control and or regulating unit is provided, which is coupled to at least one sensor device and at least one actuator and which is designed to control or regulate at least one actuator depending on the magnitude of the running clearance determined by means of the at least one sensor device.

In another advantageous embodiment of the invention, it is provided that at least two adjusting devices are arranged axially in relation to the rotational axis of the rotor and can be actuated jointly by means of the adjusting element. Because the rotors of several stages of a turbomachine designed as a high-pressure compressor show a similar temporal expansion behavior—especially when the thermal expansion coefficients of the materials used are similar—the running clearances of several stages can adjusted using the same movement of the adjusting element. In doing so, it may be provided that—for example, through different lever lengths at the adjusting devices—different stroke movements can be achieved at the segments of the multipart casing of various stages. In addition, if necessary, a different running clearance can be produced at each stage.

In another advantageous embodiment of the invention, it is provided that at least one adjusting device comprises an actuating lever and/or a thrust bearing and/or a recirculating ball thread and/or a spindle drive and/or a camshaft and/or a flexing spring and/or a spring element and/or a toggle lever, and/or a catch mechanism. In this way, it is possible in a simple manner to ensure a variable linkage to the adjusting element and play-free transmission of force from the adjusting element to the adjusting device. This enables, in turn, exactly the same play-free and, if appropriate, catch movement of the respectively associated segment. In addition, the at least one adjusting device thereby makes it possible in a simply designed way to convert an at least predominantly axial movement of the adjusting element into a much smaller radial movement of the segment of the casing.

Further advantages result when at least one adjusting device comprises a sealing element, which is designed preferentially as a band clamp and/or bellows seal and/or piston ring and/or C seal. On the one hand, such a sealing element may be used to provide the required movement possibility—for example, a stroke movement or thermal difference expansion—and, on the other hand, compartments having different pressures can be sealed with respect to one another at the same time.

In another advantageous embodiment of the invention, it is provided that at least one adjusting device comprises a tension bolt, which is coupled to at least one segment, and a pressure bolt, which is coupled to at least one segment, with the tension bolt and the pressure bolt being movable relative to each other and force-loaded against each other. Advantageously, as a result of this, the entire adjusting device is intrinsically pretensioned and thus free of play, so that it is possible to realize an especially precise clearance adjustment. The application of force between tension bolt and pressure bolt can be effected using a spring element, for example, with it being fundamentally possible to provide for any arbitrary spring shape design, such as coil springs, Belleville spring packages, or the like.

Another aspect of the invention relates to a turbomachine, in particular a gas turbine, having a rotor comprised of rotor blades, a casing that surrounds at least sections thereof and comprises at least two segments, and a clearance control system, by means of which a clearance between the rotor and the casing can be adjusted. In order to enable a compensation of as many influencing variables as possible and thus a reliable and safe-to-operate adjustability of the running clearance under various operating states of the turbomachine in a simply designed way, it is provided in accordance with the invention that the clearance control system is designed according to one of the preceding embodiment examples. The advantages resulting from this may be taken from the corresponding descriptions and regarded as advantages of the turbomachine.

In another embodiment, it is provided that the clearance control system is accommodated in a housing and/or forms at least a part of the housing. The accommodation of the turbomachine in a housing enables a mechanically stable, safe-to-operate, and space-saving arrangement of the clearance control system. Alternatively or additionally, it may be provided that the clearance control system itself forms at least a part of the housing. This results in the achievement of an appreciable lowering of cost and weight on account of synergistic effects.

Further advantages result when the casing comprises at least one guide vane. When the at least one guide vane is provided on the casing or on a segment, the running clearances on the inner contour of the annulus, that is, the clearance between the rotor and the at least one guide vane, are adjusted by way of the clearance control system. The forces produced during operation of the turbomachine then act on the segments.

In another advantageous embodiment of the invention, it is provided that the at least two segments of the casing are coupled to each other preferably by means of at least one adjusting device of the clearance control system. This ensures a high tightness of the casing and a correspondingly high efficiency of the turbomachine. A coupling by means of at least one common adjusting device enables adjacent regions of two segments to be moved radially jointly in an advantageous manner. In this way, in addition, a steady transition from one segment to the adjacent segment is ensured, so that the formation of sickle-shaped running clearances is prevented in an especially reliable manner. In addition, the juncture between the segments and the adjusting device thereby also achieves a high freedom of play.

In another advantageous embodiment of the invention, it is provided that at least one segment comprises a stiffening element, by means of which the curvature of the segment can be adjusted depending on the magnitude of the running clearance. Use of such a stiffening element enables the stiffness distribution of the segment of the casing to be chosen such that, under all operating states of the turbomachine, it is possible to produce a constant curvature. As a result, an at least nearly ideal circular shape is retained when the radial position of the segment is adjusted. The stiffening element in this case can be designed as a rib having variable radial design height or as ribs with decreasing width on going toward the segment edges, with it being thereby possible to adjust the stiffness distribution to the respective requirement profile of the turbomachine in a simply designed and cost-effective manner.

In another advantageous embodiment of the invention, it is provided that the clearance control system is arranged in the region of a low-pressure compressor stage and/or a high-pressure compressor stage and/or a low-pressure turbine stage and/or a high-pressure turbine stage of the turbomachine. Such an arrangement allows an especially variable embodiment of the turbomachine as well as an especially high efficiency, which is at least largely independent of the operating state.

Further advantages result when the casing comprises two segments, constructed as half-rings and/or at most eight, especially preferably at most six segments. In this way, in contrast to prior art, the number of components and hence the potential leakage sites is kept small. Besides a reduction in manufacturing costs of the turbomachine, the assembly and servicing friendliness is thereby appreciably improved.

In another embodiment, it is provided that each segment of the casing is coupled to at least three mutually spaced adjusting devices of the clearance control system. As a result of this, the creation of a constant curvature of each segment is ensured in an especially reliable manner. In doing so, it can be provided that the adjustability of a constant curvature is promoted by a corresponding geometric shape and/or a stiffness distribution of the segments. To this end, for example, it is possible to choose a cross-sectional contour of each segment such that the second derivative of the deflection line affords a constant value and a constant curvature can accordingly be produced under all operating states of the turbomachine.

Further advantages result when several casings are arranged along the rotational axis of the rotor, with creation of several running clearances, and the running clearances can be adjusted jointly by means of the clearance control system between the rotor and the casings. As a result of this, the running clearances of several stages of the turbomachine can be adjusted advantageously jointly by means of the clearance control system, affording significant savings in cost and weight.

A further aspect of the invention relates to a method for adjusting a running clearance between a rotor having rotor blades of a turbomachine, especially a gas turbine, and a casing that surrounds at least sections thereof and comprises at least two segments. In order to enable a compensation of as many influencing variables as possible and thus a reliable and safe-to-operate adjustability of the running clearance under various operating states of the turbomachine, the method in accordance with the invention comprises at least the following steps: determination of the magnitude of the running clearance by means of at least one sensor device and transmission of the magnitude to a control and/or regulating unit, control or regulation of at least one actuator by means of the control and/or regulating unit depending on the determined magnitude of the running clearance, axial shift and/or pivoting, in relation to a rotational axis of the rotor, of an adjusting element arranged around the rotor by means of at least one actuator, actuation of at least one adjusting device by means of the adjusting element, and radial movement, in relation to the rotational axis of the rotor, of at least one segment of the casing by means of the at least one adjusting device. The advantages resulting from this may already be taken from preceding descriptions of the clearance control system or the turbomachine. In doing so, it may be provided that a turbomachine or a clearance control system according to one of the preceding embodiment examples is used.

In an advantageous embodiment of the invention, it is provided that the magnitude of the running clearance is determined in the case of a defective sensor device by means of the control and/or regulating unit on the basis of the magnitude transmitted by another sensor device and the at least one actuator is controlled or regulated depending on the determined magnitude. As a result of this, an increased failure safety can be achieved through an appropriate control or regulating logic by having at least one actuator being controlled as a function of the measured signals of the other, intact sensor device.

Figure 2:
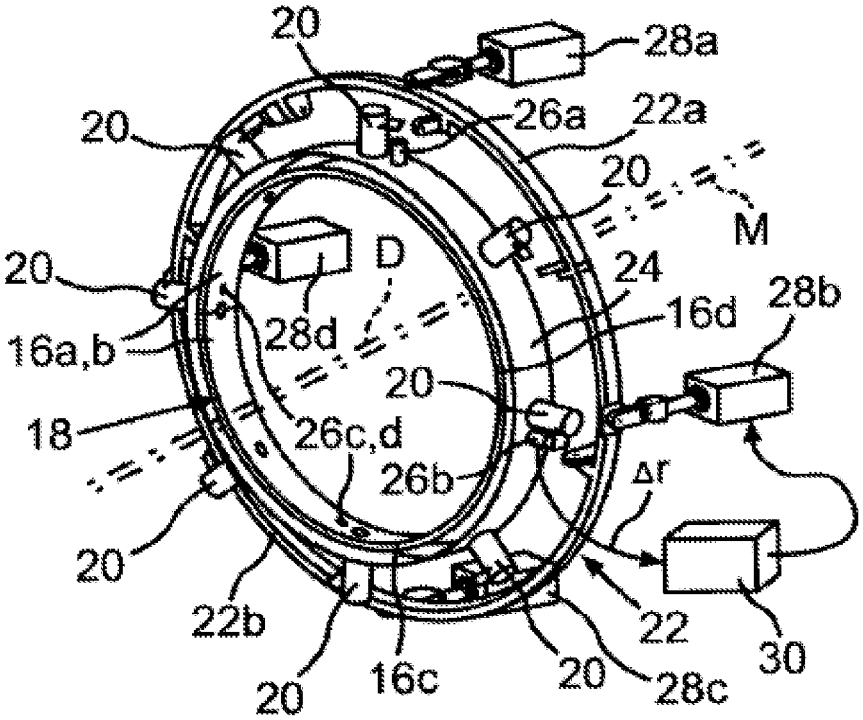
Figure 3:
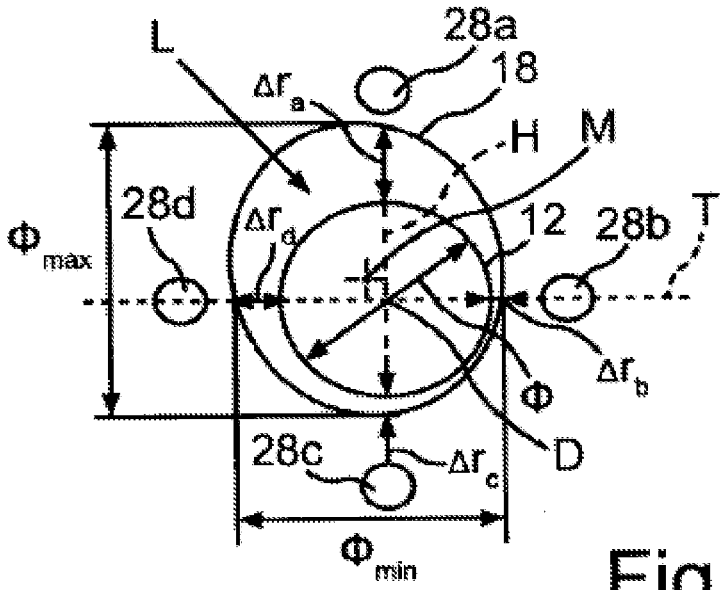
Figure 4:
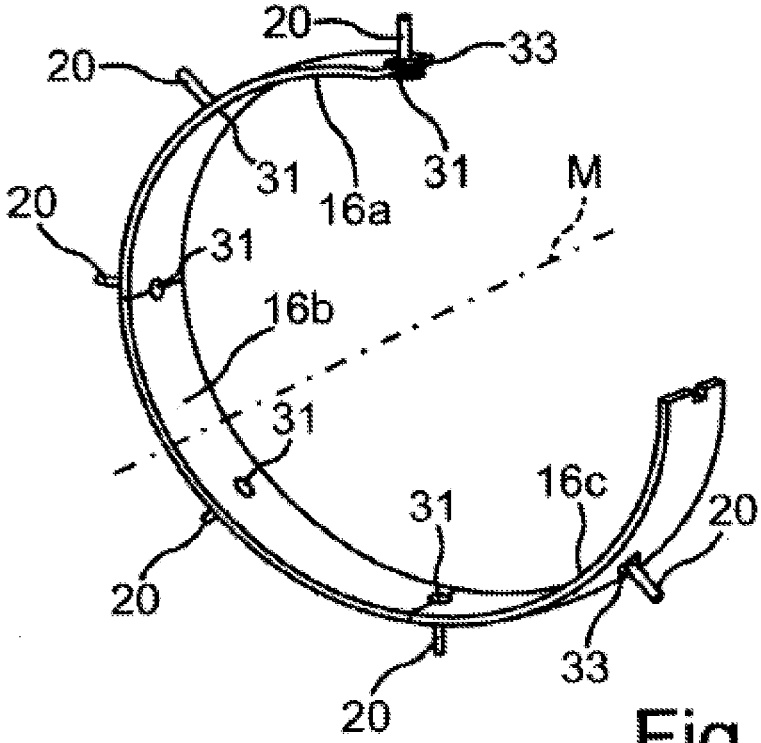
Figure 5:
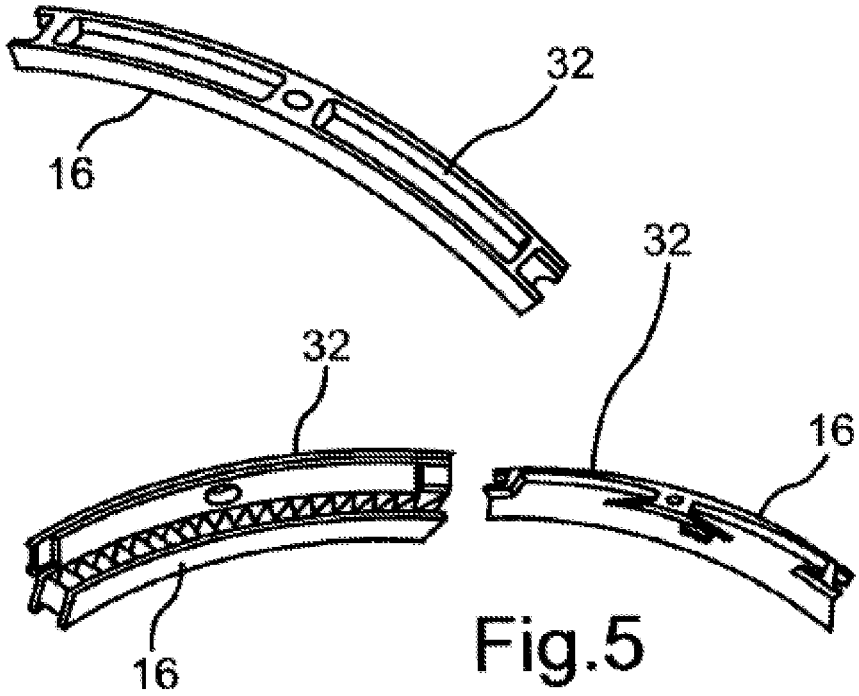
Figure 6:
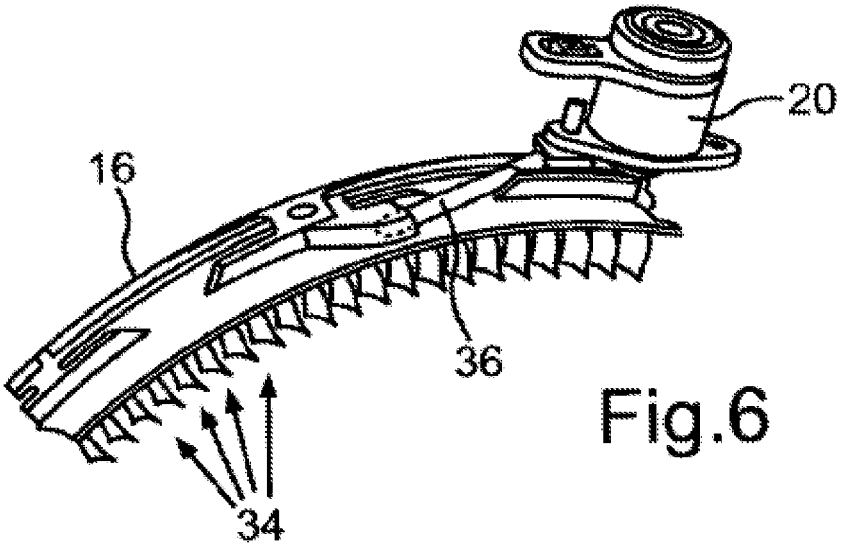
Figure 7:
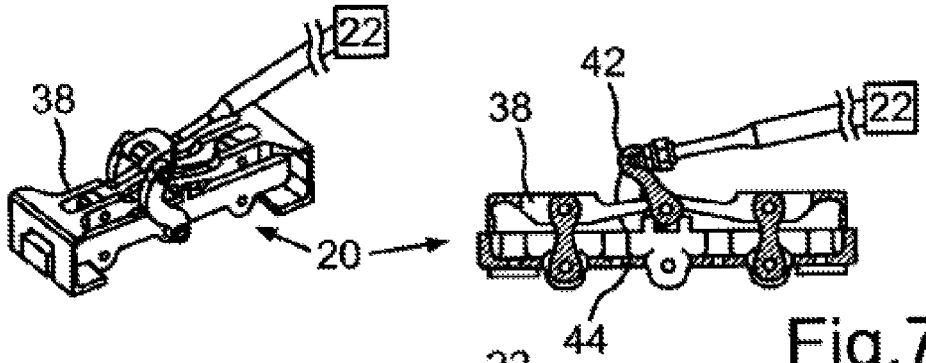
Figure 8:
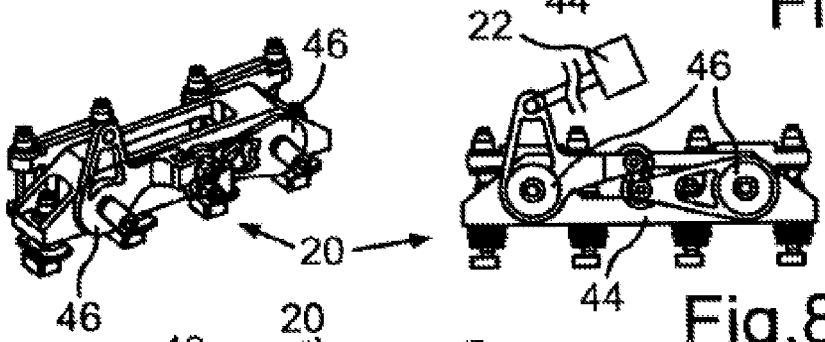
Figure 9:
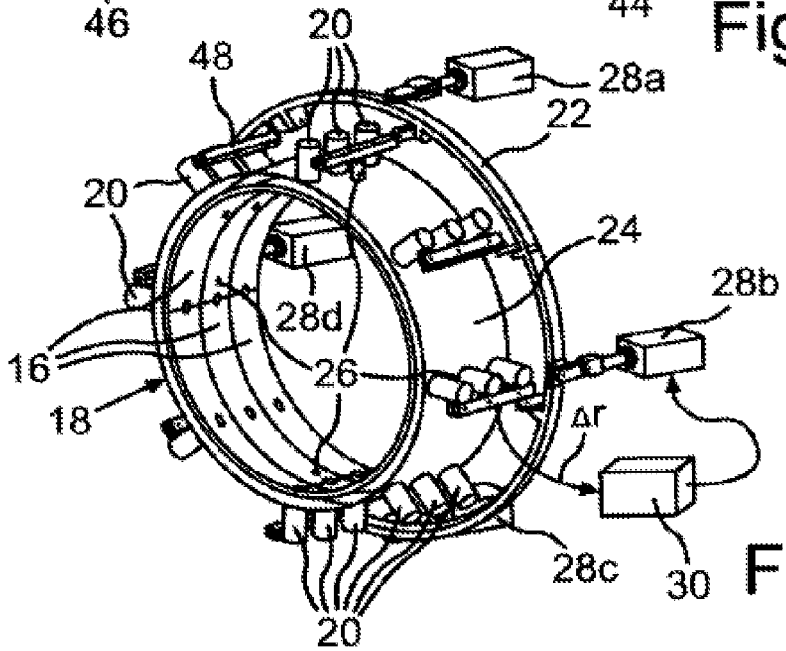
Figure 10:
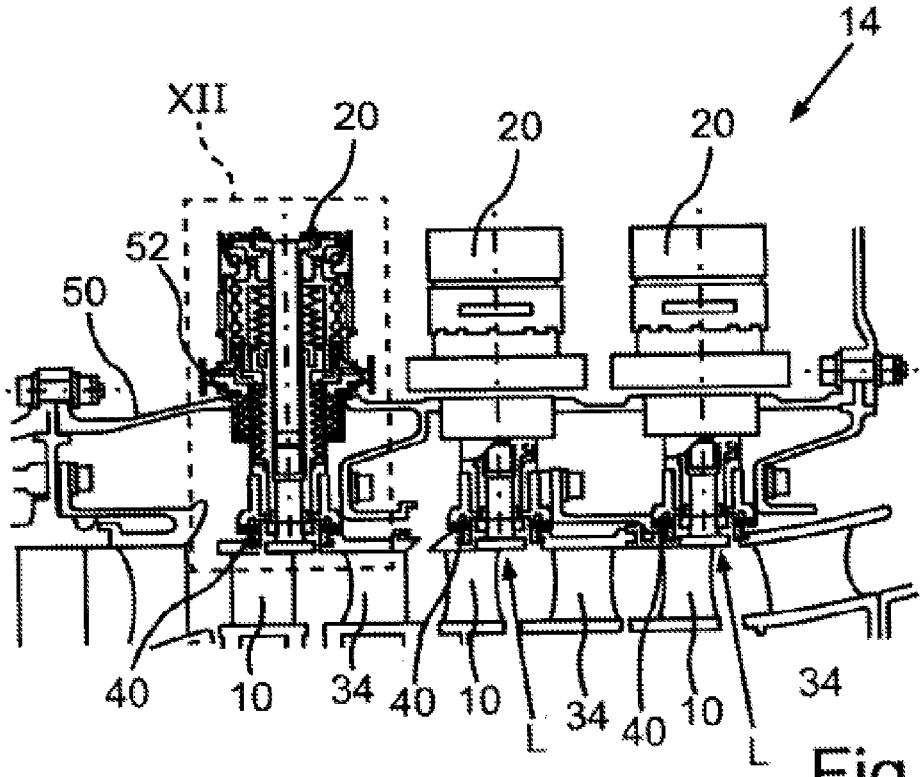
Figure 11:
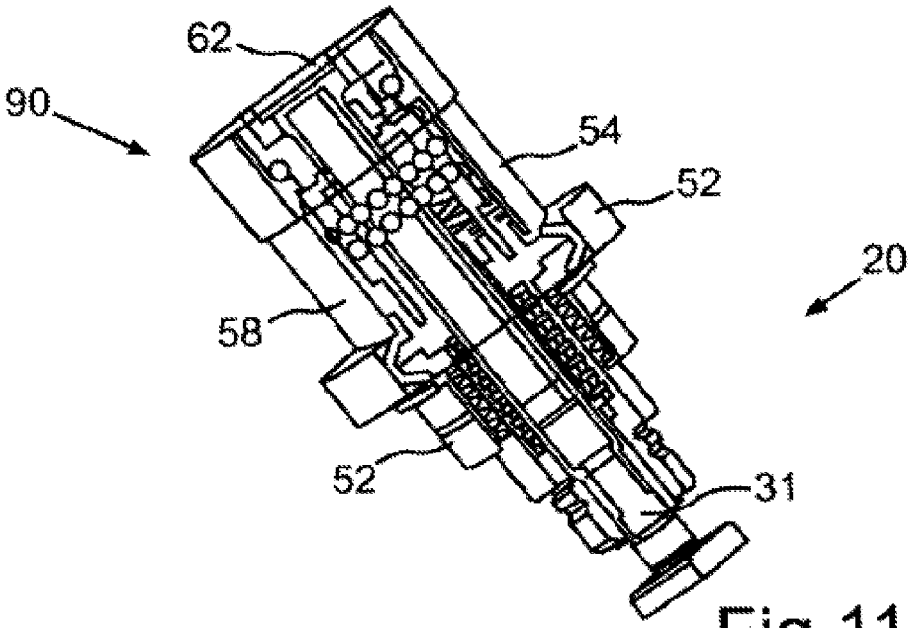
Figure 12:
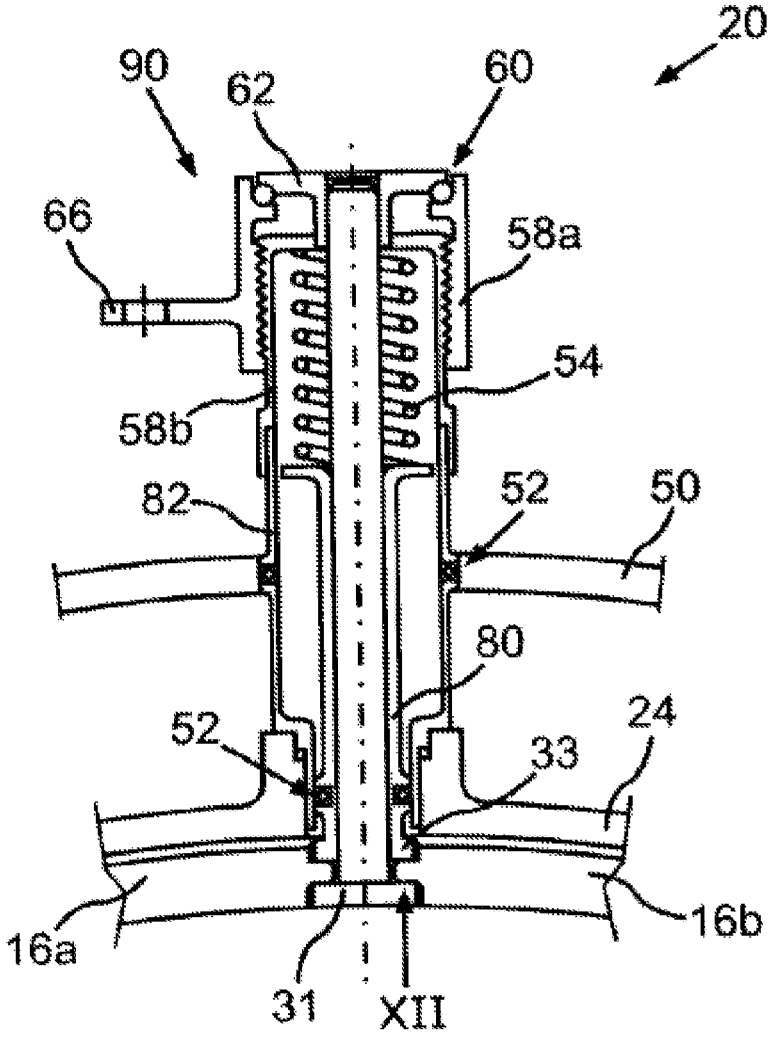

The features and combinations of features mentioned in the description as well as the features and combination of features mentioned below in the embodiment examples may be used not only in the respectively given combination, but also in other combinations or alone, without departing from the scope of the invention. Further advantages, features, and details of the invention ensue on the basis of the following description of embodiment examples as well as on the basis of drawings, in which identical or functionally identical elements are provided with identical reference signs. Shown are:

FIG. 1 a schematic line chart of a time- and load-dependent change in radius of a rotor and of a casing surrounding it of a turbomachine;

FIG. 2 a schematic perspective view of a clearance control system according to a first embodiment example;

FIG. 3 a schematic sectional view of the clearance control system shown in FIG. 2, with an ovalization of the casing occurring in addition to a change in diameter and a central-axis displacement;

FIG. 4 a schematic perspective view of three segments of the casing shown in FIG. 2, with each segment being coupled to several adjusting devices of the clearance control system;

FIG. 5 several embodiment examples of segments of the casing provided with stiffening elements;

FIG. 6 a schematic perspective view of a segment having several guide vanes, which is supported against a support housing by means of a thrust rod;

FIG. 7 an embodiment example of the adjusting device in schematic perspective and side view;

FIG. 8 another embodiment example of the adjusting device in schematic perspective and side view;

FIG. 9 a schematic perspective view of the clearance control system according to a second embodiment example;

FIG. 10 a schematic and, in cutouts, side sectional view of a turbomachine with the clearance control system shown in FIG. 9;

FIG. 11 a schematic and partially cutout perspective view of an adjusting device shown in FIG. 9; and FIG. 12 a schematic side sectional view of the adjusting device according to a further embodiment example.

FIG. 1 shows a schematic line chart of a time- and load-dependent change in radius of a rotor and a casing surrounding it of a turbomachine and was already explained above. In order to achieve always the optimal running clearance $\Delta r_{opt}$ and thus an optimal efficiency, regardless of the operating state of the turbomachine, it is necessary, as described, to use a clearance control system to adapt the actual radius, characterized by the line $\phi$2, of the casing of the rotor to the target radius, characterized by the dotted line $\phi$3.

FIG. 2 shows a perspective view of a clearance control system according to a first embodiment example. The clearance control system serves here to adjust the running clearance L between a rotor 12 (see FIG. 3) having rotor blades 10 (see FIG. 10) of a turbomachine 14 (see FIG. 10), particularly of a gas turbine, and a casing 18 that surround at least sections thereof. In order to achieve a running clearance L that is as small as possible, taking into account all relevant influencing variables, it is necessary that the casing 18 can adapt at each point in time via the rotor 12 to the diameter or the radius and the position of the rotor 12 or its rotational axis D. For this purpose, the casing 18 in the present embodiment example has four segments 16*a-d* (liner), which can be moved at least largely independently of one another. The clearance control system comprises in the present case eight adjusting devices 20, designed as adjusting gear units, each of which is coupled to at least one segment 16 of the casing 18. Alternatively, it may be provided that the adjusting devices 20 are designed as actuators, control rods, or the like or else comprise actuators, control rods, or equivalent elements. The segments 16*a-d* can be moved by means of the adjusting devices 20 for radial adjustment of the running clearance in relation to a rotational axis D of the rotor 12. Furthermore, the clearance control system comprises an adjusting element 22, which can be arranged around the rotor 12 and which is designed in essence as a ring in the present case and comprises two half-rings as subsections 22*a*, 22*b*, joined to each other in an articulated manner. The adjusting element 22 is coupled to the adjusting devices 20 and can be shifted axially in relation to the rotational axis D of the rotor 12 or pivoted with respect to the rotor 12 for actuation of the adjusting devices 20 and hence for adjustment of the running clearance L. The adjusting devices 20 are correspondingly designed to transform an at least predominantly axial movement of the adjusting element 22 into an at least predominantly radial movement of the respectively associated segments 16*a-d* of the casing 18. The segments 16*a-d* are arranged within a support housing 24, which has a ring-shaped construction and is arranged concentrically in relation to the rotational axis of the rotor 12. The support housing 24 in this case can be designed as an outer housing of the turbomachine 14 or else lie within a separate outer housing. The adjusting devices 20—and hence indirectly the adjusting element 22—are fixed in place in the support housing 24. Additionally fixed in place at the support housing 24 in the near vicinity of each second adjusting device 20 are a total of four sensor devices 26*a-d*, which are equally spaced from one another, by means of which the magnitude of the running clearance L can be determined at different positions on the circumference. Arranged between the support housing 24 and the radially shiftable segments 16*a-d* are sealing elements (not shown). The sealing elements may be designed as sealing platelets (so-called "leaf seals"), although other types of seal—for example, brush seals or C rings—may also be provided. The sealing elements 40 prevent the segments 16*a-d* from circulating in the axial direction on the support-housing side.

The clearance control system further comprises four actuators 28*a-d*, which are coupled to the adjusting element 22 and by means of which the adjusting element 22 can be shifted axially in relation to the rotational axis D of the rotor 12 or can be pivoted with respect to the rotor 12. The actuators 28*a-d* in this case are arranged equally spaced from one another on the outer circumference of the casing 18 as well as respectively in the region of an adjusting device 20. The clearance control system has a control and/or regulating unit 30, which is coupled to the sensor devices 26*a-d* and the actuators 28*a-d*. The control and/or regulating unit 30 is designed to control or regulate the actuators 28*a-d* depending on the magnitude $\Delta r$ of the running clearance L determined by means of the sensor devices 26*a-d*. To this end, the control signals delivered by the sensor devices 26*a-d* are processed in the control and/or regulating unit 30.

Normally, the respective actuator 26*a-d* associated with the pertinent sensor device 26*a-d* receives a signal from the control and/or regulating unit 30 to move the adjusting element axially until the pertinent sensor device 26*a-d* can determine the optimal magnitude $\Delta r_{opt}$ of the running clearance L. The same thing happens at the other sensor positions. As a result of this, it is possible to carry out different stroke movements of the segments 16*a-d* at different positions on the circumference. The sensor devices 26*a-d* may work according to various physical principles—for example, capacitatively, inductively, optically, with microwaves, or with eddy current. The same holds true for the actuators 28*a-d*, which can be operated, for example, hydraulically, pneumatically, electrically, piezoelectrically, or magnetically.

In the case of error—for example, the failure of a sensor device 26*a-d*—the actuator 26*a-d* whose normally assigned sensor device 26*a-d* has failed can nonetheless be actuated via an appropriate error logic by way of the preferably redundantly designed control and/or regulating unit 30. To this end, a corresponding control signal may be derived, for example, from the signals of the remaining functional sensor device 26*a-d*.

When there is a uniform change of the running clearance over the circumference, the adjusting element 22 is axially shifted by all actuators 28*a-d* in relation to the rotational axis D of the rotor 12. When there is a displacement of the central axis M of the support housing 24 with respect to the rotational axis D, the adjusting element 22 is moved, by contrast, differently in the axial direction at the individual actuator positions. The adjusting element 22 thereby carries out a spatial pivoting movement with respect to the rotor 12 or its rotational axis D (wobbling motion). As a result of this, it is possible to adjust a constant running clearance L over the entire circumference of the casing 18. A special advantage of the adjusting devices 20 in this case lies in the fact that they are able to transform relatively large movements of the actuators 28*a-d* into relatively small movements of the segments 16*a-d*, as a result of which the running clearance L can be adjusted especially precisely.

It applies fundamentally that, during a rotation of the rotor 12, a point at a tip of a rotor blade 10 describes an ideal circular path. A circle is definitively determined when three spatial points lying at different circumferential positions in the plane of the circle are known. If the case of ovalization of the casing 18 is ignored for the time being, a total of three sensor devices 26 and three actuators 28, which are connected to a one-piece adjusting element 22, are sufficient to adjust a constant running clearance L over the circumference of the casing 18 in different operating states of the turbomachine.

FIG. 3 shows a schematic sectional view of the clearance control system shown in FIG. 2, with a displacement between the central axis M and the rotational axis D as well as an ovalization of the casing 18 occurring in addition to a change in the diameter ϕ or the radius of the rotor 12. The casing 18 thereby has a minimum diameter $\phi_{min}$ as well as a maximum diameter $\phi_{max}$, as a result of which the running clearance L varies over the circumference and has different magnitudes $\Delta r_{a-d}$.

The clearance control system already explained in FIG. 2 comprises the four actuators 28*a-d* and the four sensor devices 26*a-d* for adjusting a constant running clearance L. Each of the actuators 28*a-d* moves the adjusting element 22 differently far along the rotational axis D, thereby producing a pivoting movement. This is made possible by the multipart and articulated design of the adjusting element 22. A linear shift of the adjusting element 22 along the central axis M or the rotational axis D enables a uniform change in radius of the casing 18 to be achieved. A tilting of the adjusting element 22 with respect to the central axis M allows compensation of central line displacement. Finally, the four actuators 28*a-d* can be used to compensate fully for an ovalization also by "dog-earing" the adjusting element 22, that is, by relative pivoting of the subsections 22*a*, 22*b* with respect to one another when the articulated connection of the subsections 22*a*, 22*b* of the adjusting element 22 lies in a plane formed by the engine axis T and a principle axis H of the resulting cross-sectional ellipse. In the case of an arbitrary position of the principle axes H of the cross-sectional ellipses, the ovalization is compensated for only partially. If the ovalization is to be compensated for at least nearly fully even in the case of an arbitrary position of the cross-sectional ellipses, it has proven advantageous to have a further subdivision of the adjusting element 22 into, for example, three subsections or to use six actuators 28. However, because the ovalization of the casing 18 is normally small in comparison to the displacement between the central axis M and the rotational axis D, a clearance control system having four actuators 28 has generally been found to be fully sufficient. In summary, the clearance control system in accordance with the invention is capable of adjusting the running clearance L over the circumference of the casing 18 by using different adjustment paths. As a result of this, it is possible to respond both to changes in the diameter ϕ and the radius r of the rotor 12 and to a displacement between the central axis M of the casing 18 and the rotational axis D of the rotor 12 as well as to an ovalization of the casing 18.

FIG. 4 shows a schematic perspective view of three segments 16*a-c* of the casing 18 shown in FIG. 2, with each segment 16*a-c* being coupled to several adjusting devices 20 of the clearance control system. The segments 16*a-c* are usually produced for a specific diameter. If the relatively large segments 16*a-d* were simply shifted onto another radius, sickle-shaped running clearances L would result on account of their curvature. In addition, for non-stationary operating states of the turbomachine, a radial temperature gradient, which changes the curvature in an uncontrolled manner, as well as deformations due to mechanical stress (for example, due to gas loads) must be taken into account. In order to ensure the required curvature of the segments 16*a-d*, therefore, each segment 16*a-d* is coupled to an adjusting device 20 at three positions on the circumference and forced by these onto a circular path having the current rotor diameter plus the desired running clearance L. One adjusting device 20 is thereby assigned to two segments 16.

The segments 16*a-d* are joined in a tight form-fitting manner in the radial direction with their respectively adjacent segments 16 to the segment edges. The tight fit is produced by a tension bolt 31 and a spring-loaded pressure plate 33 of the adjusting device 20. As a result of this, freedom of play is also achieved at the juncture of the segments 16*a-d* with the respective adjusting devices 20. In the circumferential direction, the segments 16*a-d* can be shifted with respect to one another, this being necessary, on the one hand, because of the different temperatures between the segments 16*a-d* and the support housing 24 arising during operation and, on the other hand, due to the possibility of radially shifting the segments 16*a-d* (a radial shift of all segments 16*a-d* by 0.5 mm, for example, results in change of 3.14 mm in the length of the circumference). The stiffness distribution between the engagement points of the adjusting devices 20 at the segments 16*a-d* is chosen such that a constant curvature exists under all operating conditions.

To this end, FIG. 5 shows several embodiment examples of segments 16, respectively provided with stiffening elements 32. The stiffening elements 32 are used to maintain a nearly ideal circular shape when the radial position of the segments 16*a-d* is varied. The stiffening elements 32 in this case may be designed in one piece with the segments 16. Possible embodiments of the stiffening elements 32 include, for example, variation of the radial design height of the segment 16 or ribs with decreasing width on going toward the segment edges. In this way, it is possible to adapt optimally the stiffness distribution of the segments.

FIG. 6 shows a schematic perspective view of a segment 16 comprising several guide vanes 34, which is supported indirectly with respect to the support housing 24 (not illustrated) of the turbomachine by means of a thrust rod 36 mounted at its ends in an articulated manner. In the present case, a stiffening element of the adjusting device 20 functions simultaneously as a support element for the thrust rod 36, so that any arising forces are passed into the support housing. The guide vanes 34 can be designed as separate components or as an integral component of the segments 16. Alternatively or additionally, the guide vanes 34 can be fixed in place on the support housing 24. When the guide vanes 34 are fixed in place on the segments 16, as shown, the running clearances on the annulus inner contour, that is, the running clearance between the rotor 12 and the guide vanes 34, are also adjusted by the clearance control system. The forces produced by the guide vanes 34 then act on the segment 16. In order for the clearance control system not to be influenced detrimentally by these forces, it is appropriate to dissipate and distribute the forces by means of the thrust rod 36.

FIG. 7 shows an embodiment example of the adjusting device 20 in schematic perspective and side view. The adjusting device 20 also enables the transformation of a predominantly axial movement of the adjusting element 22 into a small radial movement of the associated segment 16. The adjusting device 20 comprises a flexing spring 38, which is mounted on the support housing 24 and can be deformed by way of a toggle lever mechanism 42 coupled to the adjusting element 22. A traverse 44 appended to the flexing spring 38 transmits the movement to the segment 16.

Another embodiment example of the adjusting device 20 is shown in FIG. 8 in schematic perspective and side view. Here, the radial movement of the traverse 44 and thus of the segment 16 is produced by turning of the camshaft 46 that is coupled to the adjusting element 22.

FIG. 9 shows a schematic perspective view of the clearance control system according to a second embodiment example. The fundamental design in this case is already known from the description of FIG. 2. In contrast to the first embodiment example, the present clearance control system comprises several groups of respectively three adjusting devices 20, which are coupled to one another via a coupling rod 48 and which are respectively arranged axially in relation to the rotational axis D of the rotor 12 and can be actuated jointly by means of the adjusting element 22. Correspondingly, the casing 18 comprises several groups of segments 16, which are also arranged along the rotational axis D of the rotor 12. The clearance control system is therefore suitable particularly for multistage turbomachines. Because the rotor expansions of the stages in a high-pressure compressor show a similar behavior—especially when the thermal expansion coefficients of the materials used are chosen similarly—it is possible, in conjunction with an optimizing of the temporal expansion behavior of the support housing 24 (geometric shape, mass distribution, insulation, and the like), to compensate with respect to one another the clearance behavior of the stages to the greatest extent possible. Different lever lengths at the adjusting devices 20 allow different stroke movements at the segments 16 of the various stages to be achieved when the axial movement of the adjusting element 22 is the same. In addition, a different running clearance L can be adjusted at each stage. As a result of this, it is possible to adjust the running clearance L of other stages with the same actuator movement by determining the running clearance magnitude at one stage.

FIG. 10 shows a schematic and, in cutouts, side sectional view of a multistage turbomachine 14 provided with the clearance control system shown in FIG. 9. The turbomachine 14 and the clearance control system will be explained below by viewing FIG. 11 and FIG. 12 as well. Here, FIG. 11 shows a schematic and partially cut-out perspective view of an adjusting device 20 shown in FIG. 10, while finally, in FIG. 12, a schematic side sectional view of the adjusting device 20 according to another embodiment example is shown. The general design of the turbomachine in this case is known from prior art. The three adjusting devices 20 that can be seen in FIG. 10 are arranged along the rotational axis of the rotor 12 and fixed in place on a support housing 24 of the turbomachine 14. On account of a comparable expansion behavior, the three adjusting devices 20 are jointly controlled and actuated. Fundamentally, however, it may be provided that the adjusting devices 20 are controlled or regulated individually or in groups. The clearance control system in this case can fundamentally be arranged both in the compressor and in the turbine stages. Special advantages result when the clearance control system is arranged in the region of back stages of the turbomachine, because, for these, the relation between running clearance and blade size is especially relevant on account of the small blades.

Each adjusting device 20 is sealed with sealing elements 52. Two liner segments 16*a*, 16*b* are pressed radially inward in the direction of the rotor 12 by a spring element 54 (for example, coil spring, Belleville spring package, etc.) via a pressure sleeve 80 and the pressure plate 33. In order that no segment 16 is moved into the rotor 12, each segment 16 can be moved radially away from the rotor 12 via a thread 58, which is designed as a recirculating ball thread in the embodiment example shown in FIG. 11 and as a movement thread in the embodiment example shown in FIG. 12. The force transmission occurs in each case via a thrust bearing 60 onto an anchor plate 62 and the tension bolt 31. The latter is joined in a tight form-fitting manner with the segment 16 or the segments 16*a*, 16*b*, with a sliding site between the segment 16*b* and the tension bolt 31 being marked with arrow XII in FIG. 12 by way of example. The described arrangement offers the advantage that, due to the spring element 54, the entire adjusting device 20 is tensioned and thus free of play.

The thread 58, in combination with the thrust bearing 60, offers the advantage that the adjusting device 20 has low wear and a low internal friction. In contrast to the clearance control system known from U.S. Pat. No. 5,104,287, the spring elements 54 existing in the adjusting device 20 are arranged in an integrated manner and outside of the outer housing 50 and hence in the relatively cold region of the turbomachine 14. Arranged between the outer housing 50 and the adjusting device 20 as well as within the adjusting device 20 are several sealing elements 52. These afford the components the required movement possibility (stroke movement and thermal differential expansion) and, at the same time, seal compartments with different pressures from one another. Alternatively, sealing elements 52 designed as piston rings, C seals, bellows, or the like may be provided.

Evident in FIG. 12 is an actuating lever 66 of the adjusting device 20, which, on the one hand, is coupled to the adjusting element 22 and, on the other hand, is joined to the thread 58 in a rotationally rigid manner in order to transform the at least essentially axial movement of the adjusting element 22 into a smaller radial movement. A fundamentally optional catch mechanism facilitates the desired adjustability of the clearance L in many applications. As already explained above, the adjusting device 20 functions in the manner of a spindle drive according to the embodiment example shown. The adjusting device 20 is fixed in place at the support housing 24 of the turbomachine by means of screws, welding, or the like.

Further evident in FIG. 12 is also a connection sleeve 82. The spring element 54 (coil spring, Belleville spring package, etc.) presses the segments 16*a*, 16*b* via a pressure bolt 80 and the pressure plate 33 at the segment edges or in the segment center (not shown) radially in the direction of the engine axis, with the spring element 54 resting on the bolt part of the thread 58. The nut part 58*a* of the thread 58 acts via a thrust bearing on the anchor plate 62 and via the tension bolt 31 on the segments 16*a*, 16*b* or, in the case of an arrangement in a segment center, on an individual segment 16. The tension bolt 31 counters the action of the thrust bolt 80, as a result of which the entire adjusting device 20 is pretensioned and thus free of play. Turning of the nut part 58*a* effects a radial shift of the anchor place 62 and the segments 16*a*, 16*b* indirectly connected to it. Provided at the sliding sites (arrow XII) between the adjusting device 20 and the housings (outer housing 50 and support housing 24) as well as within the adjusting device 20 are various sealing elements 52 (piston rings, C rings, bellows, etc.). The connection sleeves 82, the thread 58, and the anchor plate 52 form in the existing case an adjusting device housing 90.

The parameter values given in the documents for definition of process and measurement conditions for the characterization of specific properties of the object of the invention are to be regarded also in the scope of deviations—for example, on account of measuring errors, system errors, weighing errors, DIN tolerances, and the like—as being included in the scope of the invention.

The invention claimed is:

1. A clearance control system for adjusting a running clearance (L) between a rotor (12) having rotor blades (10) of a turbomachine (14) and a casing (18) that surrounds at least sections thereof and comprises at least two segments (16*a-d*), with at least one adjusting device (20), which is coupled to at least one segment (16*a-d*) of the casing (18), and by means of which the at least one segment (16*a-d*) for adjusting the running clearance (L) can be moved radially in relation to a rotational axis (D) of the rotor (12), characterized in that each segment (16*a-d*) of the casing (18) is coupled to at least three adjusting devices (20) of the clearance control system, wherein the at least one segment (16*a-d*) is movable independently of one another.

2. The clearance control system according to claim 1, wherein two adjusting devices (20) are arranged at oppositely placed edge regions of their associated segment (16*a-d*) and an adjusting device (20) is arranged in the middle of its associated segment (16*a-d*).

3. The clearance control system according to claim 1, wherein at least two adjacent segments (16*a-d*) are coupled to a common adjusting device (20).

4. The clearance control system according to claim 1, further comprising:

an adjusting element (22) that is arranged around the rotor (12) is provided, which element is coupled to at least one adjusting device (20) and can be moved with respect to it for actuating the adjusting device (20).

5. The clearance control system according to claim 4, wherein the adjusting element (22) comprises several subsections (22*a*, 22*b*), which are joined with one another in an articulated manner.

6. The clearance control system according to claim 4, wherein the adjusting element (22) can be at least one of shifted axially in relation to the rotational axis (D) of the rotor (12) and pivoted with respect to the rotor (12) in order to adjust the running clearance (L).

7. The clearance control system according to claim 4, wherein at least one of the adjusting devices (20) is designed to transform an at least predominantly axial movement of the adjusting element (22) into an at least predominantly radial movement of the associated segment (16*a-d*) of the casing (18).

8. The clearance control system according to claim 1, wherein at least one adjusting device (20) is fixed in place on a support housing (24).

9. The clearance control system according claim 8, wherein the support housing (24) is arranged on the outer circumference of the casing (18).

10. The clearance control system according to claim 8, wherein at least one sealing element (40) is provided, by means of which the support housing (24) is sealed with respect to the casing (18).

11. The clearance control system according to claim 8, wherein the casing (18) comprises at least one guide vane (34) and rests against the support housing (24), by means of a thrust rod (36).

12. The clearance control system according to claim 1, wherein at least one sensor device (26) is provided, for determining a magnitude (Δr) of the running clearance (L).

13. The clearance control system according to claim 12, wherein the sensor device (26) is arranged in the region of at least one adjusting device (20).

14. The clearance control system according to claim 12, wherein several sensor devices (26*a-d*) are provided, which are arranged at a spacing from one another, uniformly, or can be arranged on the outer circumference of the casing (18).

15. The clearance control system according to claim 4, wherein at least one actuator (28) coupled to the adjusting element (22) is provided, by means of which the adjusting element (22) can be shifted axially in relation to the rotational axis (D) of the rotor (12) or can be pivoted with respect to the rotor (12).

16. The clearance control system according to claim 15, wherein the actuator (28) is arranged in the region of at least one adjusting device (20).

17. The clearance control system according to claim 15, wherein several actuators (28*a-d*) are provided, which are arranged at a distance from one another, uniformly, and/or is arranged on the outer circumference of the casing (18).

18. The clearance control system according to claim 12, wherein at least one regulating unit (30) is provided, which is coupled to at least one sensor device (26*a-d*) and at least one actuator (28*a-d*) and is designed to control or regulate the at least one actuator (28*a-d*) depending on the magnitude (Δr) of the running clearance (L) determined by means of the at least one sensor device (26*a-d*).

19. The clearance control system according to claim 4, wherein at least two adjusting devices (20) are arranged axially in relation to the rotational axis (D) of the rotor (12) and can be actuated jointly by means of the adjusting element (22).

20. The clearance control system according to claim 1, wherein at least one adjusting device (20) comprises at least one of: an actuating lever (66), a thrust bearing (60), a recirculating ball thread (58), a spindle drive, a camshaft (46), a flexing spring (38), a spring element (54), a toggle lever (42), and a catch mechanism.

21. The clearance control system according to claim 1, wherein at least one adjusting device (20) comprises a sealing element (52), which is designed as one of a V-band clamp, a bellows seal, a piston ring, a C seal.

22. The clearance control system according to claim 1, wherein at least one adjusting device (20) comprises a tension bolt (31) coupled to at least one segment (16*a*, 16*b*) and a pressure bolt (80) coupled to at least one segment (16*a*, 16*b*), with the tension bolt (31) and the pressure bolt (80) being movable relative to one another and being force-loaded against one another.

23. The clearance control system according to claim 1, comprising:

a rotor (12) having rotor blades (10), the casing (18) that surrounds at least sections thereof and comprises at least two segments (16*a-d*), and a clearance control system by means of which a running clearance (L) between the rotor (12) and the casing (18) can be adjusted, wherein the rotor blades, casing and clearance control system are configured for use in a turbomachine.

24. The clearance control system according to claim 23, wherein the clearance control system is accommodated in a housing (50) forms at least a part (24) of the housing.

25. The clearance control system according to claim 23, wherein the casing (18) comprises at least one guide vane (34).

26. The clearance control system according to claim 23, wherein at least one segment (16*a-d*) of the casing (18) comprises a stiffening element (32), by means of which a curvature of the segment (16*a-d*) can be adjusted depending on the magnitude (Δr) of the running clearance (L).

27. The clearance control system according to claim 23, wherein the clearance control system is arranged in the region of one of: a low-pressure compressor stage, a high-pressure compressor stage, a low-pressure turbine stage, a high-pressure turbine stage of the turbomachine (14).

28. The clearance control system according to claim 23, wherein the casing (18) comprises between two and eight segments (16), these segments being constructed as ring segments of equal arc length.

29. The clearance control system according to claim 23, wherein each segment (16*a-d*) of the casing (18) is coupled to at least three mutually spaced adjusting devices (20) of the clearance control system.

30. The clearance control system according to claim 23, wherein several casings (18) are arranged along the rotational axis (D) of the rotor (12) with the formation of several running clearances (L) and the running clearances (L) can be adjusted jointly between the rotor (12) and the casings (18) by means of the clearance control system.

31. A method for adjusting a running clearance (L) between a rotor (12) having rotor blades (10) of a turbomachine (14) and a casing (18) that surrounds at least sections thereof and comprises at least two segments (16*a-d*), comprising the steps of:

determining the magnitude (Δr) of the running clearance (L) by means of at least one sensor device (26*a-d*) and transmission of the magnitude (Δr) to a regulating unit (30);

controlling or regulating at least one actuator (28*a-d*) by means of the regulating unit (30) depending on the determined magnitude (Δr) of the running clearance (L);

carrying out at least one of the following: axial shifting pivoting, in relation to a rotational axis (D) of the rotor (12), of an adjusting element (22) arranged around the rotor (12) by means of at least one actuator (28*a-d*); the at least one actuator (28*a-d*) being capable of causing at least two points on the adjusting element to move differently far along the rotational axis (D);

actuating at least one adjusting device (20) by means of the adjusting element (22), wherein each segment of the casing is coupled to at least three adjusting devices (20); and radially moving, in relation to the rotational axis (D) of the rotor (12), at least one segment (16*a-d*) of the casing (18) by means of the at least one adjusting device (20) and the magnitude (Δr) of the running clearance (L) is determined in the case of a defective sensor device (26*a-d*) by means of the regulating unit (30) on the basis of the magnitude (Δr) determined by another sensor device (26*a-d*) and the at least one actuator (28*a-d*) is controlled or regulated depending on the magnitude (Δr) hereby determined.

* * * * *